US007097526B2

(12) United States Patent
Raina et al.

(10) Patent No.: US 7,097,526 B2
(45) **Date of Patent: *Aug. 29, 2006**

(54) METHOD OF FORMING NITROGEN AND PHOSPHORUS DOPED AMORPHOUS SILICON AS RESISTOR FOR FIELD EMISSION DISPLAY DEVICE BASEPLATE

(75) Inventors: Kanwal K. Raina, Boise, ID (US); Benham Moradi, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/167,695

(22) Filed: Jun. 27, 2005

(65) Prior Publication Data

US 2005/0266765 A1 Dec. 1, 2005

Related U.S. Application Data

(63) Continuation of application No. 10/644,443, filed on Aug. 19, 2003, now Pat. No. 6,911,766, which is a continuation of application No. 09/388,697, filed on Sep. 2, 1999, now Pat. No. 6,635,983.

(51) Int. Cl.
*H01J 9/24* (2006.01)

(52) U.S. Cl. ..... 445/24; 445/51; 313/495

(58) Field of Classification Search ..... 313/495
See application file for complete search history.

(56) References Cited

U.S. PATENT DOCUMENTS 4,084,986 A 4/1978 Aoki et al.
4,940,916 A 7/1990 Borel et al.
5,585,301 A 12/1996 Lee et al.
5,714,415 A 2/1998 Oguro
5,789,851 A 8/1998 Turlot et al.

(Continued)

FOREIGN PATENT DOCUMENTS

JP 04168763 A 6/1992

OTHER PUBLICATIONS

Young-Chang Joo, et al. 1996. Electromigration in single-crystal aluminum lines pre-damaged by nanoindentation, *Materials Research Society Symp. Proc.*, 428:225-230.

(Continued)

*Primary Examiner*—Karabi Guharay
*Assistant Examiner*—Sikha Roy
(74) *Attorney, Agent, or Firm*—Knobbe, Martens, Olson & Bear, LLP

(57) ABSTRACT

Described herein is a resistor layer for use in field emission display devices and the like, and its method of manufacture. The resistor layer is an amorphous silicon layer doped with nitrogen and phosphorus. Nitrogen concentration in the resistor layer is preferably between about 5 and 15 atomic percent. The presence of nitrogen and phosphorus in the silicon prevents diffusion of Si atoms into metal conductive layers such as aluminum, even up to diffusion and packaging temperatures. The nitrogen and phosphorus also prevent defects from forming at the boundary between the resistor layer and metal conductor. This leads to better control over shorting and improved resistivity in the resistor.

14 Claims, 5 Drawing Sheets

U.S. PATENT DOCUMENTS 5,866,930 A 2/1999 Saida et al.
5,902,650 A 5/1999 Feng et al.
6,015,323 A 1/2000 Moradi et al.
6,019,657 A 2/2000 Chakvorty et al.
6,031,250 A * 2/2000 Brandes et al. ..... 257/77
6,064,149 A 5/2000 Raina
6,181,308 B1 1/2001 Cathey et al.
6,190,929 B1 2/2001 Wang et al.
6,211,608 B1 4/2001 Raina et al.
6,635,983 B1 10/2003 Raina et al.
6,650,043 B1 * 11/2003 Derraa ..... 313/497

OTHER PUBLICATIONS

Atsushi Masuda, et al. May 15, 1997. Nitrogen-doping effects on electrical, optical, and structural properties in hydrogenated amorphous silicon. American Institute of Physics. *J. Appl. Phys.*, 81(10):6729-6737.

C-K. Hu, et al. 1993. Electromigration damage in fine A1 alloy lines due to interfacial diffusion. *Materials Research Society Symp. Proc.*, 309:111-120.

* cited by examiner

METHOD OF FORMING NITROGEN AND PHOSPHORUS DOPED AMORPHOUS SILICON AS RESISTOR FOR FIELD EMISSION DISPLAY DEVICE BASEPLATE

RELATED APPLICATIONS

This application is a continuation of U.S. patent application Ser. No. 10/644,443, filed Aug. 19, 2003, now U.S. Pat. No. 6,911,766, which is a continuation of U.S. patent application Ser. No. 09/388,697, filed Sep. 2, 1999, now U.S. Pat. No. 6,635,983. The disclosure of the aforementioned patents is incorporated herein by reference in their entirety.

REFERENCE TO GOVERNMENT CONTRACT

This invention was made with United States Government support under Contract No. DABT63-97-C-0001, awarded by the Advanced Research Projects Agency (ARPA). The United States Government has certain rights in this invention.

BACKGROUND OF THE INVENTION

1. Field of the Invention

This invention relates to a resistor layer for a field emission device and the like, and more particularly, to a resistor layer that prevents shorting in a field emission display baseplate.

2. Description of the Related Art

A field emission device (FED) typically includes an electron emission tip configured for emitting a flux of electrons upon application of an electric field to the field emission device. An array of miniaturized field emission devices can be arranged on a plate and used for forming a visual display on a display panel. Indeed, field emission devices have been shown to be a promising alternative to cathode ray tube display devices. For example, field emission devices may be used in making flat panel display devices for providing visual display for computers, telecommunication and other graphics applications. Flat panel display devices typically have a greatly reduced thickness compared to the generally bulky cathode ray tubes.

Field emission display devices are currently being touted as the flat panel display type poised to take over the liquid crystal display (LCD) market. FEDs have the advantages of being lower in cost, with lower power consumption, having a better viewing angle, having higher brightness, having less smearing of fast moving video images, and being tolerant to greater temperature ranges than other display types.

One problem with FEDs has been the shorting of the resistor layer. In the FED structure, a resistor layer is typically provided over a metallic layer in an FED baseplate. Conventional materials used are a boron-doped amorphous silicon for the resistor layer, and chromium, aluminum, aluminum alloys or a combination of such materials for the metallic layer. Short-circuiting of the device may occur in this structure because of diffusion of silicon from the resistor layer into the metal at temperatures above about 300° C. This problem is especially prevalent when the resistor layer is deposited directly over an aluminum layer. Diffusion of silicon into the aluminum will take place, for instance, during deposition at temperatures from about 330 to 400° C., or during packaging of the baseplate at temperatures of about 450° C. This diffusion problem is caused primarily because Si forms a eutectic contact with Al above 400° C., and also because the free energy of silicon is higher in its amorphous state.

Another problem is that resistor layers made of boron-doped amorphous silicon cause nucleation related defects at the interface of the resistor and metal, especially when the metal is chromium. In an FED structure using a chromium metallic layer, for instance, the interaction of diborane gas at the chromium surface causes irregularities at the surface between the metal and resistor. Discontinuities in the resistor layer can cause the loss of the benefits for which the resistor layer was used in the first place. Additionally, discontinuities in the resistor layer can present problems when subsequent etching or photolithographic processes are conducted, potentially causing delamination of various layers and other irregularities.

Accordingly, what is needed is an improved resistor having fewer defects and discontinuities to prevent short-circuiting in FED devices and the like.

SUMMARY OF THE INVENTION

Briefly stated, the needs addressed above are solved by providing an amorphous silicon resistor layer doped with nitrogen and phosphorus over a metallic layer of aluminum, chromium, or both. For instance, in an FED structure having either a metallic layer of aluminum or a chromium/aluminum bilayer, a nitrogen-phosphorous-doped silicon resistor layer is deposited over the metal. The use of nitrogen-doped silicon solves the problems stated above because the N—Si bond is longer and stronger than the B—Si bond. Therefore, Si is less likely to diffuse out of the resistor layer into the aluminum to cause short-circuiting. Furthermore, the strength of the N—Si bond makes the atoms in the resistor layer less mobile, thereby diminishing the nucleation problem at the resistor/metal interface.

In one aspect of the present invention, a resistive structure is provided comprising a metallic conductive layer and a resistor layer over the conductive layer. The resistor layer comprises nitrogen-doped amorphous silicon, preferably with about 5 to 15 atomic percent nitrogen. The metallic conductive layer is preferably selected from the group consisting of an aluminum layer, a chromium layer and an aluminum/chromium bilayer.

In another aspect of the present invention, a field emission display device is provided comprising a substrate and a conductive layer over the substrate. An amorphous silicon resistor layer is provided over the conductive layer, the resistor layer being doped with nitrogen and phosphorus. A dielectric layer is provided over the resistor layer. A gate electrode is provided over the dielectric layer, the gate electrode including a gate conductive layer.

In another aspect of the present invention, a resistor layer is provided for field emission devices, comprising amorphous silicon doped with at least about five atomic percent nitrogen. The resistor layer also preferably has a phosphorus concentration of about $1\times10^{20}$ and $5\times10^{20}$ atoms/cm$^3$.

In another aspect of the present invention, a method is provided for forming a resistive structure. A conductive layer is formed over a substrate. A resistor layer is formed over the conductive layer, the resistor layer being formed of amorphous silicon having dopants of nitrogen and phosphorus. In one preferred embodiment, the resistor layer is formed by introducing gases of $NH_3$, $PH_3$, $SiH_4$ and $H_2$. The $NH_3$ gas is preferably introduced at a rate of about 35 and 120 sccm. The $PH_3$ gas is preferably introduced at a rate of about 50 to 100 sccm. The $SiH_4$ gas is preferably introduced at a rate of about 500 sccm.

DETAILED DESCRIPTION OF THE PREFERRED EMBODIMENTS

The preferred embodiments are field emission display devices having a resistor that eliminates short circuiting of the device. It will be appreciated that although the preferred embodiments are described with respect to FED devices, the methods and apparatus taught herein are applicable to other devices where it is desired to eliminate short-circuiting and defect-related problems between a resistor-type layer and a metallic layer.

Figure 1:
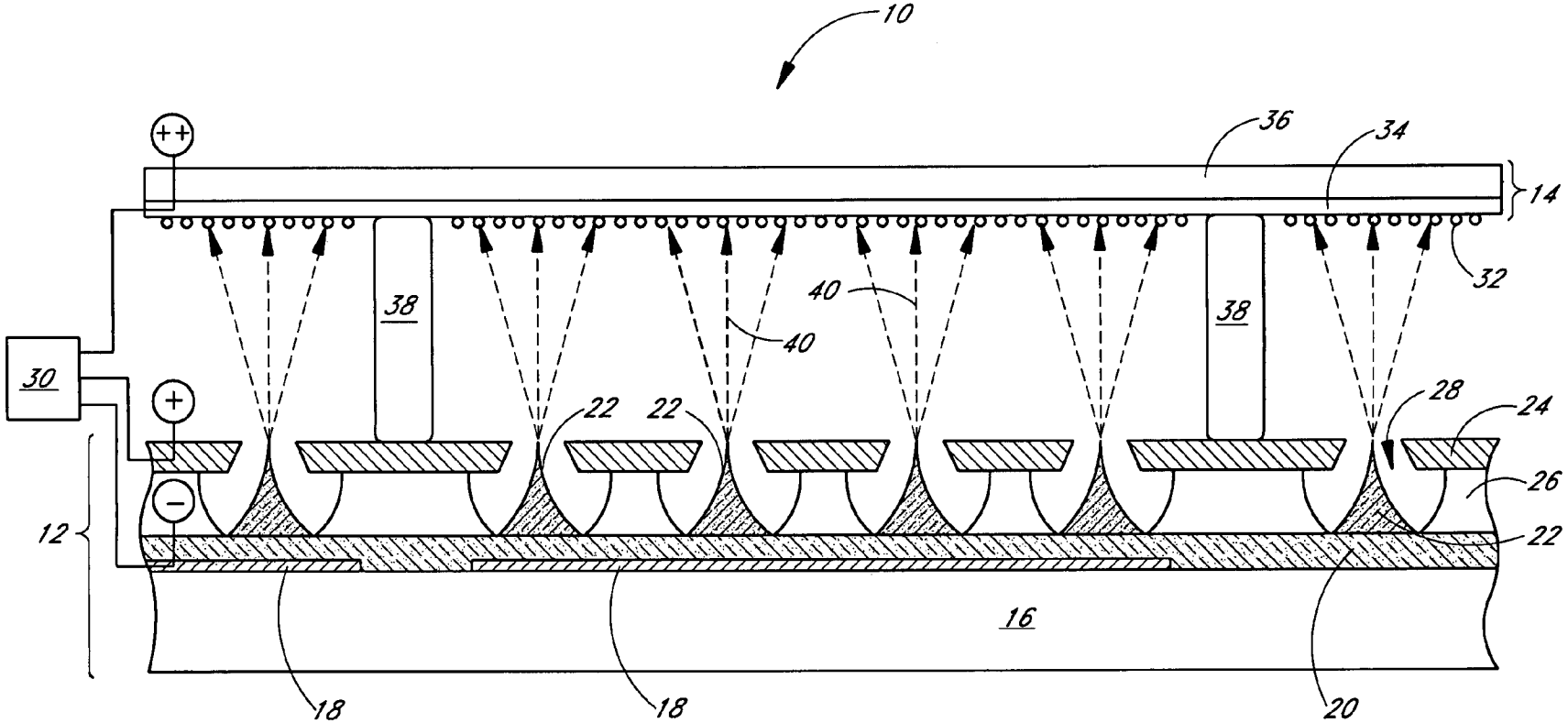
FIG. 1 (PRIOR ART)
FIG. 1 is a cross sectional view of a flat panel display including a plurality of field emission devices.

FIG. 1 illustrates a portion of a conventional flat panel display, including a plurality of field emission devices. Flat panel display 10 comprises a baseplate 12 and a faceplate 14. Baseplate 12 includes substrate 16, which is preferably formed from an insulative glass material. Column interconnects 18 are formed and patterned over substrate 16. The purpose and function of column interconnects 18 is disclosed in greater detail below. Furthermore, a resistor layer 20, which is also discussed in greater detail below, may be disposed over column interconnects 18. Electron emission tips 22 are formed over substrate 16 at the sites from which electrons are to be emitted, and may be constructed in an etching process from a layer of amorphous silicon that has been deposited over substrate 16. Electron emission tips 22 are protrusions that may have one or many shapes, such as pyramids, cones, or other geometries that terminate at a fine point for the emission of electrons.

An extraction grid 24, or gate, which is a conductive structure that supports a positive charge relative to the electron emission tips 22 during use, is separated from substrate 16 with a dielectric layer 26. Extraction grid 24 includes openings 28 through which electron emission tips 22 are exposed. Dielectric layer 26 electrically insulates extraction grid 24 from electron emission tips 22 and the associated column interconnects which electrically connect the emission tips with a voltage source 30.

Faceplate 14 includes a plurality of pixels 32, which comprise cathodoluminescent material that generates visible light upon being excited by electrons emitted from electron emission tips 22. For example, pixels 32 may be red/green/blue full-color triad pixels. Faceplate 14 further includes a substantially transparent anode 34 and a glass or another transparent panel 36. Spatial support structures 38 are disposed between baseplate 12 and faceplate 14 and prevent the faceplate from collapsing onto the baseplate due to air pressure differentials between the opposite sides of the faceplate. In particular, the gap between faceplate 14 and baseplate 12 is typically evacuated, while the opposite side of the faceplate generally experiences ambient atmospheric pressure.

The flat panel display is operated by generating a voltage differential between electron emission tips 22 and grid structure 24 using voltage source 30. The voltage differential activates electron emission tips 22, whereby a flux of electrons 40 is emitted therefrom. In addition, a relatively large positive voltage is applied to anode 34 using voltage source 30, with the result that flux of electrons 40 strikes the faceplate. The cathodoluminescent material of pixels 32 is excited by the impinging electrons, thereby generating visible light. The coordinated activation of multiple electron emission tips over the flat panel display 10 may be used to produce a visual image on faceplate 14.

Figure 2:
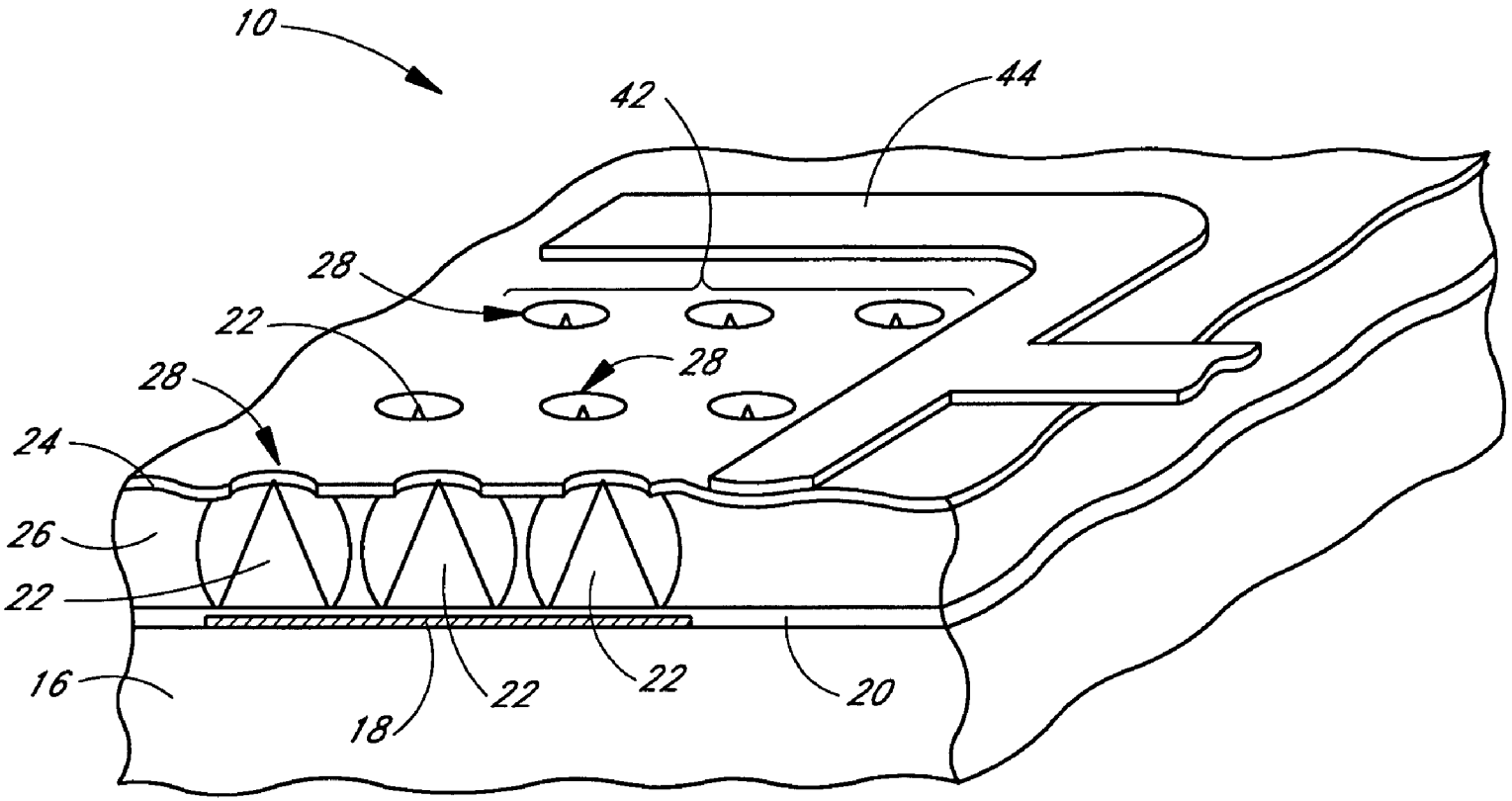
FIG. 2 (PRIOR ART)
FIG. 2 is an isometric view of a baseplate of a flat panel display, showing an emitter set comprising a plurality of electron emission tips.
Figure 3:
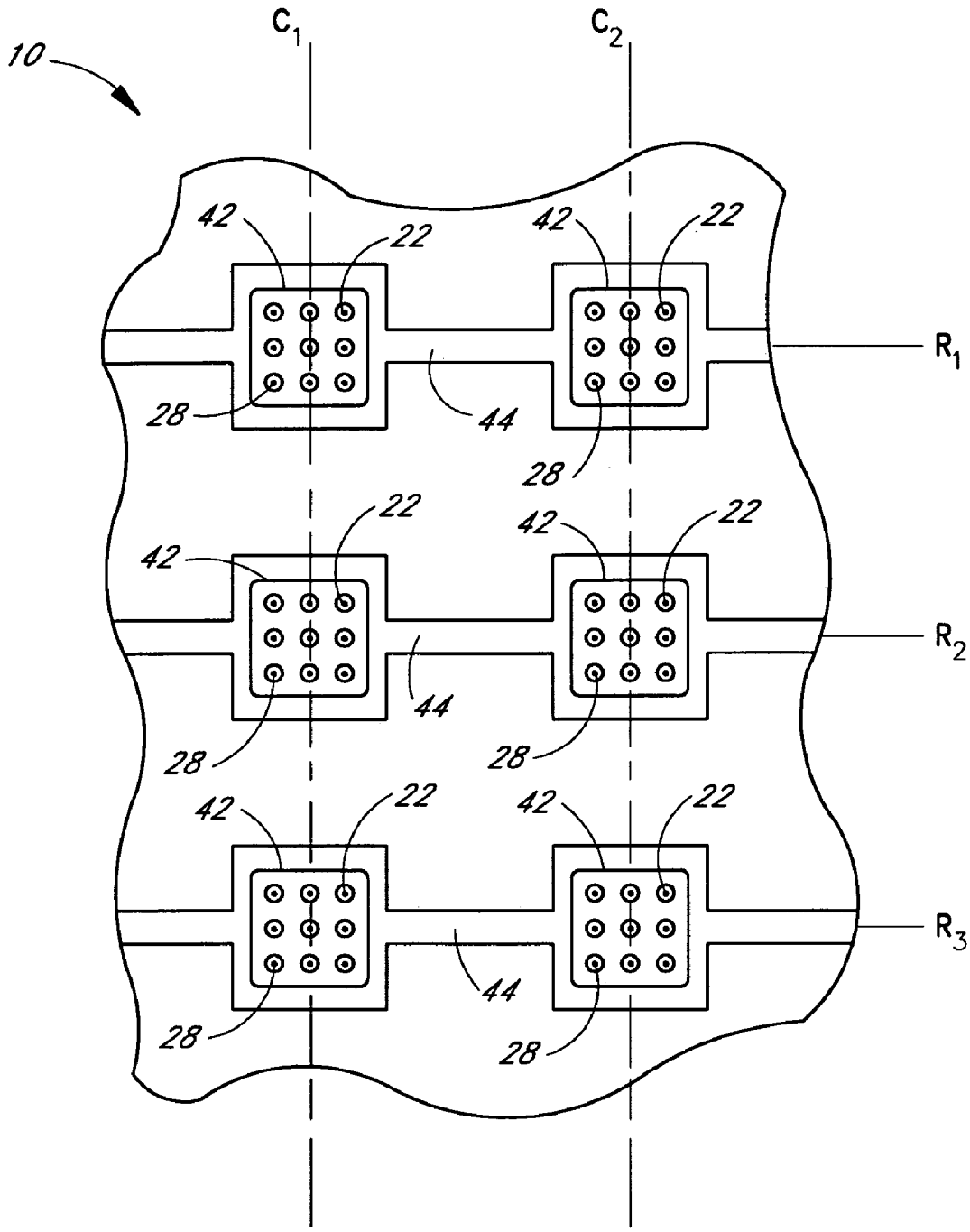
FIG. 3 (PRIOR ART)
FIG. 3 is a top view of the flat panel display of FIG. 2, showing the addressable rows and columns.

FIGS. 2 and 3 further illustrate conventional field emission devices. In particular, electron emission tips 22 are grouped into discrete emitter sets 42, in which the bases of the electron emission tips in each set are commonly connected. As shown in FIG. 3, for example, emitter sets 42 are configured into columns (e.g., $C_1$–$C_2$) in which the individual emitter sets 42 in each column are commonly connected. Additionally, the extraction grid 24 is divided into grid structures, with each emitter set 42 being associated with an adjacent grid structure. In particular, a grid structure is a portion of extraction grid 24 that lies over a corresponding emitter set 42 and has openings 28 formed therethrough. The grid structures are arranged in rows (e.g., $R_1$–$R_3$) in which the individual grid structures are commonly connected in each row. Such an arrangement allows an X-Y addressable array of grid-controlled emitter sets. The two terminals, comprising the electron emission tips 22 and the grid structures, of the three terminal cold cathode emitter structure (where the third terminal is anode 34 in faceplate 14 of FIG. 1) are commonly connected along such columns and rows, respectively, by means of high-speed interconnects. In particular, column interconnects 18 are formed over substrate 16, and row interconnects 44 are formed over the grid structures.

In operation, a specific emitter set is selectively activated by producing a voltage differential between the specific emission set and the associated grid structure. The voltage differential may be selectively established through corresponding drive circuitry that generates row and column signals that intersect at the location of the specific emitter set. Referring to FIG. 3, for example, a row signal along row $R_2$ of the extraction grid 24 and a column signal along column $C_1$ of emitter sets 42 activates the emitter set at the intersection of row $R_2$ and column $C_1$. The voltage differential between the grid structure and the associated emitter set produces a localized electric field that causes emission of electrons from the selected emitter set.

Further details regarding FED devices are disclosed in assignee's U.S. Pat. No. 6,211,608 and U.S. Pat. No. 5,372,973, both of which are hereby incorporated by reference in their entirety.

Figure 4:
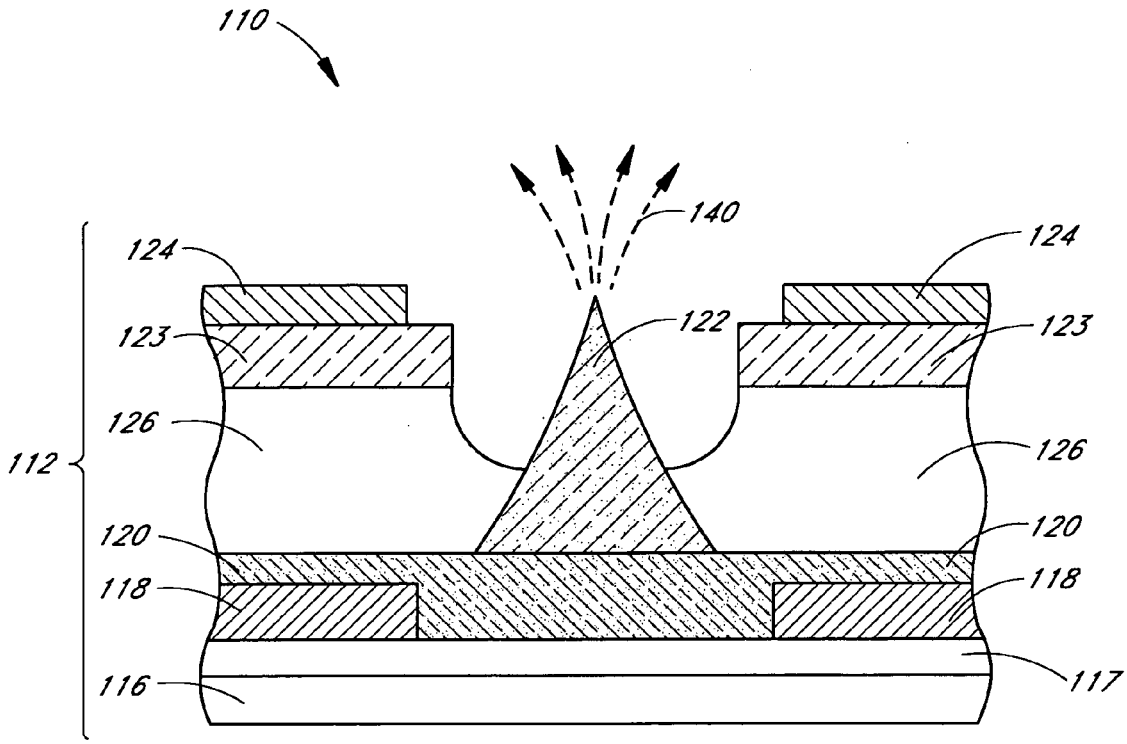
FIG. 4 is a schematic diagram of an emission tip of a field emission display device having an aluminum alloy conductive layer.

FIG. 4 shows more particularly a baseplate 112 and emitting unit of an FED 110 according to a preferred embodiment of the present invention. The base or substrate 116 is preferably made of glass, though the skilled artisan will recognize that other suitable materials such as a semiconductor substrate and the like may also be used. In particular, a soda-lime glass substrate is especially suitable for the preferred embodiment of the present invention. Soda-lime glass, which is characterized by durability and relatively low softening and melting temperatures, commonly contains, but is not limited to, silica ($SiO_2$) with lower concentrations of soda ($Na_2O$), lime (CaO), and optionally oxides of aluminum, potassium, magnesium or tin.

Although the substrate 116 is electrically insulative, an insulative layer 117 may optionally be formed on substrate 116. An insulative layer limits diffusion of impurities from substrate 116 into overlying layers and facilitates adhesion of a subsequent layer. Further, the electrically insulative qualities of an insulative layer prevent leakage of current and charge between conductive structures situated thereover. Silicon dioxide is a preferred material for the insulative layer 117, and is preferably formed to a thickness in a range from about 2,000 Å to about 2,500 Å, and most preferably, about 2,000 Å.

Figure 5:
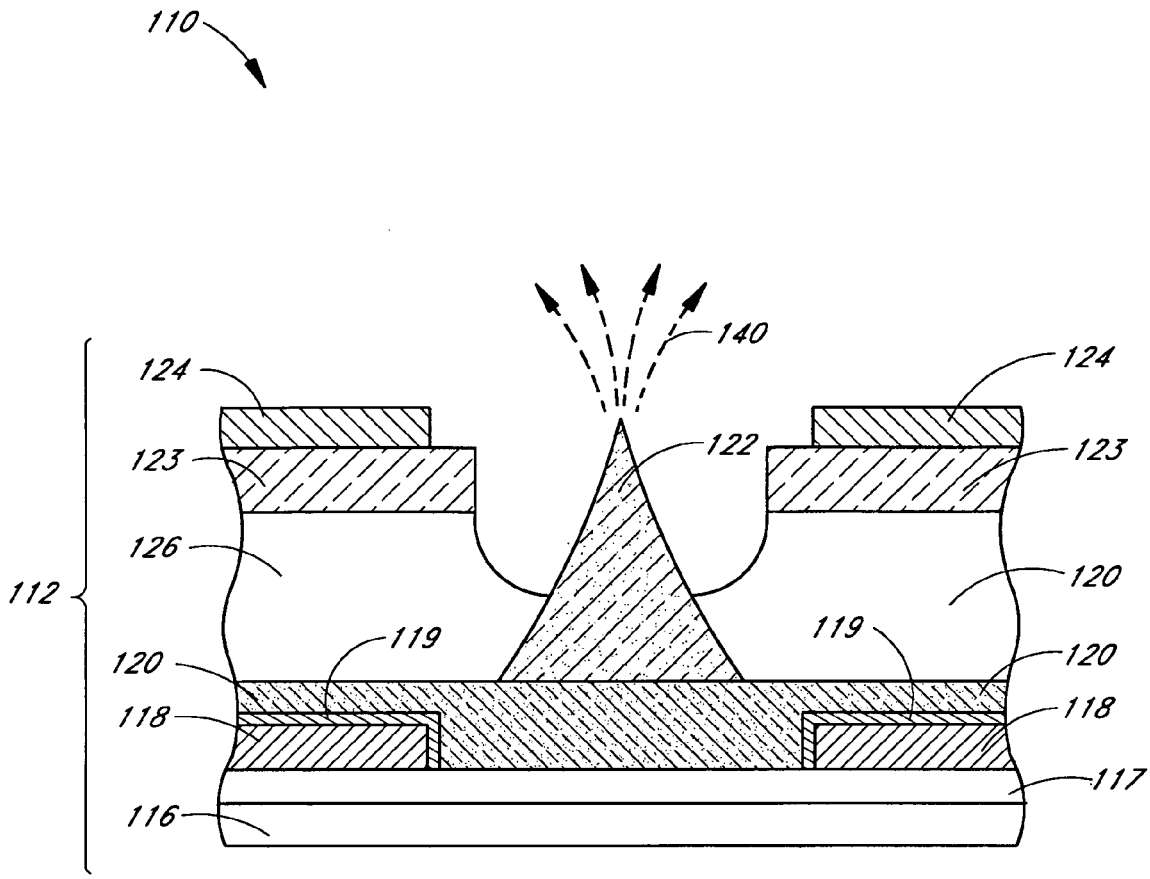
FIG. 5 is a schematic diagram of an emission tip of a field emission display device having a chromium/aluminum alloy conductive layer.

A cathode conductive layer is formed on insulative layer 117. In one embodiment, as shown in FIG. 4, the cathode conductive layer is a metal layer preferably formed of an aluminum alloy. It will be appreciated that other materials, such as chromium, may also be used. In another embodiment, as shown in FIG. 5, the cathode conductive layer is a bilayer including an aluminum alloy layer 118, and a chromium layer 119 deposited over the aluminum layer 118. The chromium layer creates a diffusion barrier between the aluminum layer 118 and the subsequently deposited resistor layer, described below. The aluminum layer and chromium layer of these embodiments are preferably formed by plasma vapor deposition (PVD) sputtering. In either of the embodiments of FIG. 4 or 5, the cathode conductive layer preferably has a thickness in a range from about 2,000 Å to about 2,500 Å, more preferably, about 2,000 Å.

In the illustrated FED 110 of FIGS. 4 and 5, a resistor layer 120 overlies the cathode conductive layer. The layer 120 is preferably an amorphous silicon layer doped with nitrogen and phosphorus. The layer 120 can be deposited through PECVD in an atmosphere of a mixture of $NH_3$, $PH_3$, $SiH_4$ and $H_2$. In one preferred embodiment, $NH_3$ is introduced at a rate of about 35 to 120 sccm, more preferably about 40–70 sccm. $PH_3$ is preferably introduced at a rate of about 50 to 100 sccm, more preferably about 100 sccm. $SiH_4$ is introduced at a rate of about 500 sccm, and $H_2$ is introduced at a rate of about 500 sccm. It will be appreciated that other gases and flow rates may also be used to obtain the desired doping of the layer 120. PECVD is preferably conducted at RF power of about 300 to 500 watts at a pressure of 1200 mtorr. The electrotrode distance is preferably about 960 mils. The thickness of the layer 120 is preferably between about 2,000 and 7,500 Å.

It has been found that nitrogen-phosphorus-doped amorphous silicon having a bulk resistivity in a range, for example, from about 500 to $10^4$ ohm-cm, satisfactorily regulates current flow through many completed field emission devices. By way of example, and not by limitation, resistor layer 120 is doped with nitrogen at a concentration in the range of about 5 to about 15 atomic percent, and phosphorus at a concentration in the range of about $1\times10^{20}$ atoms/$cm^3$ to about $5\times10^{20}$ atoms/$cm^3$. It will be appreciated by those skilled in the art that the ratio of silane to $NH_3$ and $PH_3$ will be determined by the dopant concentrations desired, and ultimately, by the desired resistivity of resistor layer 120. For instance, increasing the nitrogen concentration increases the resistivity of the layer.

Silane is the preferred source of silicon in the PECVD processes because the resulting amorphous silicon layers have some hydrogen alloyed therein. Amorphous silicon is inherently photosensitive, in that photons can cause variation in its electrical resistivity. Hydrogen alloying reduces photosensitivity and stabilizes resistivity of silicon, which is particularly beneficial in the light-producing display panel applications of the present invention. The concentration of hydrogen is regulated by a suitable power/pressure combination. For example, low power in a range from about 150 W to about 300 W and high pressure in a range of about 1,000 mTorr to about 1,500 mTorr are combined to satisfactorily control the amount of hydrogen in resistor layer 120, which subsequently determines the light sensitivity of resistor layer 120.

The emitter tip 122 may be formed of any material from which electron emission tips may be formed, especially those materials having a relatively low work function, so that a low applied voltage will induce a relatively high electron flow therefrom. A preferred material for emitter layer 122 is phosphorus-doped amorphous silicon formed by methods that are understood by those skilled in the art. By way of example, and not by limitation, emitter layer 122 is doped with phosphorus at a concentration that may be in the range from about $1\times10^{20}$ to about $5\times10^{20}$ atoms/$cm^3$.

An insulating layer or dielectric layer 126 is formed over resistor layer 120 around the emission tip 122. The insulating layer 126 shown in FIGS. 4 and 5 may be a dielectric oxide such as silicon dioxide, borophosphosilicate glass, or similar material. The purpose of this layer is to electrically separate electron emission tip 122 and resistor layer 120 from overlying conductive layers. The thickness of the insulating layer 126 is preferably about 0.5 to 2 μm, more preferably, about 0.75 to 1 μm.

As illustrated, a layer 123 of grid silicon is formed between the dielectric layer 126 and the gate layer 124. Gate conductive layer 123 is formed on dielectric layer 126, and contains, for example, phosphorus-doped amorphous silicon, the phosphorus being present, for example, at a concentration that may be in a range from about $1\times10^{20}$ atoms/$cm^3$ to about $1\times10^{21}$ atoms/$cm^3$, more preferably, about $1\times10^{20}$ atoms/$cm^3$. Gate conductive layer 124 is formed on gate conductive layer 123. Chromium is a preferred material for gate conductive layer 124. As illustrated in FIGS. 4 and 5, layer 123 preferably has a thickness of about 0.1 to 1 μm, and layer 124 preferably has a thickness of about 0.2 to 0.3 μm.

Further details regarding the fabrication of these layers are more fully described in U.S. Pat. No. 5,372,973 and U.S. Pat. No. 6,211,608, both of which are hereby incorporated by reference in their entirety.

The FED structure described above, and more particularly, the resistive structure including the metal conductive layer and resistor layer 120, advantageously reduces diffusion of silicon from the resistor layer 120 into the aluminum layer 118 to prevent short-circuiting. This is because, in comparison to previously known resistor layers which used boron-doped amorphous silicon, the FED structure of the preferred embodiments use amorphous silicon doped with nitrogen and phosphorus. In particular, the Si—N is a much stronger bond than the Si—B bond. Therefore, Si is held in more tightly within the resistor layer 120, thereby minimizing diffusion of the silicon out of the resistor layer 120 into the aluminum layer 118. It has been found that amorphous silicon doped with nitrogen and phosphorus as described above can be effective to prevent diffusion for structures using aluminum alloy conductive layers, such as shown in FIG. 4, up to temperatures of about 390° C. or more, and up to about 450° C. or more for a Cr/Al or Al-alloy bilayer metal structure, such as shown in FIG. 5. Moreover, as shown in FIG. 5, the chromium layer 119 between the aluminum layer 118 and the resistor layer 120 acts as a diffusion barrier between the two layers to further prevent diffusion of silicon into the aluminum layer 118.

The presence of nitrogen in the resistor layer 120 also eliminates defects in the resulting FED structure. In particular, when a chromium conductive layer 119 is used, previously known resistor layers doped with boron would cause silicon to aggregate and form nucleation sites at the chromium surface, thereby leading to defects. This nucleation is caused primarily by the instability of the Si—B bond. By using a resistor layer doped with nitrogen instead, the stronger Si—N bond reduces the instability in the structure, and therefore, fewer nucleation sites are created. It has been found that this improvement is largely unaffected by temperature. Phosphorus is present in the resistor layer to reduce or control the resistivity of the layer.

The preferred embodiments described above are provided merely to illustrate and not to limit the present invention. Changes and modifications may be made from the embodiments presented herein by those skilled in the art, without departing from the spirit and scope of the invention, as defined by the appended claims.

What is claimed is:

1. A method for forming a resistive structure comprising:

forming a conductive layer over a substrate; and forming a resistor layer over said conductive layer, said resistor layer being formed of amorphous silicon having dopants of nitrogen and phosphorus, wherein said nitrogen dopant concentration is sufficient to prevent diffusion of silicon out of said resistor layer into said conductive layer.

2. The method of claim 1, wherein forming a conductive layer over a substrate comprises forming a layer of aluminum over said substrate.

3. The method of claim 2, further comprising forming a layer of chromium over said layer of aluminum prior to the forming said resistor layer over said conductive layer.

4. The method of claim 1, wherein forming a conductive layer over a substrate comprises forming a layer of chromium over said substrate.

5. The method of claim 1, wherein said resistor layer is formed by introducing gases of $NH_3$, $PH_3$, $SiH_4$, and $H_2$.

6. The method of claim 1, wherein said resistor layer comprises nitrogen bonding with silicon to prevent diffusion of silicon out of said resistor layer into said conductive layer.

7. The method of claim 1, further comprising:

forming a dielectric layer over said resistor layer; and forming a gate electrode over said dielectric layer, said gate electrode including a gate conductive layer;

to form a field emission display device;

wherein said resistor layer comprises nitrogen bonding with silicon to prevent diffusion of silicon out of said resistor layer into said conductive layer.

8. A method for forming a resistive structure comprising:

forming a conductive layer over a substrate; and forming a resistor layer over said conductive layer, said resistor layer being formed of amorphous silicon having dopants of nitrogen and phosphorus, wherein said nitrogen dopant concentration is sufficient to reduce nucleation sites at the surface between said resistor layer and said conductive layer.

9. The method of claim 8, wherein forming a conductive layer over a substrate comprises forming a layer of aluminum over said substrate.

10. The method of claim 9, further comprising forming a layer of chromium over said layer of aluminum prior to the forming said resistor layer over said conductive layer.

11. The method of claim 8, wherein forming a conductive layer over a substrate comprises forming a layer of chromium over said substrate.

12. The method of claim 8, wherein said resistor layer is formed by introducing gases of $NH_3$, $PH_3$, $SiH_4$, and $H_2$.

13. The method of claim 8, wherein said resistor layer comprises nitrogen bonding with silicon to reduce nucleation sites at the surface between said resistor layer and said conductive layer.

14. The method of claim 8, further comprising:

forming a dielectric layer over said resistor layer; and forming a gate electrode over said dielectric layer, said gate electrode including a gate conductive layer;

to form a field emission display device;

wherein said resistor layer comprises nitrogen bonding with silicon to reduce nucleation sites at the surface between said resistor layer and said conductive layer.

* * * * *